United States Patent [19]

Zilly et al.

[11] Patent Number: 4,458,565

[45] Date of Patent: Jul. 10, 1984

[54] TORQUE LIMITING POWER SCREWDRIVER

[75] Inventors: Günter Zilly; Erich Borst, both of Leinfelden; Brigitte Hertell, Waldenbuch; Fritz Schädlich, Leinfelden-Echterdingen; Heinz Walz, Stuttgart; Steffen Wünsch, Dettenhausen, all of Fed. Rep. of Germany

[73] Assignee: Robert Bosch GmbH, Stuttgart, Fed. Rep. of Germany

[21] Appl. No.: 427,262

[22] Filed: Sep. 29, 1982

[30] Foreign Application Priority Data

Mar. 15, 1982 [DE] Fed. Rep. of Germany ..... 3209395

[51] Int. Cl.[3] ..... B25B 23/14

[52] U.S. Cl. ..... 81/469; 81/475; 173/12

[58] Field of Search ..... 81/467, 469, 470, 473, 81/474, 475; 173/12, 164

[56] References Cited

U.S. PATENT DOCUMENTS

| | | | |
|---|---|---|---|
| 4,006,785 | 2/1977 | Roll et al. | 173/12 |
| 4,064,948 | 12/1977 | Bratt et al. | 173/12 |
| 4,078,618 | 3/1978 | DePagter et al. | 173/12 |
| 4,088,197 | 5/1978 | Roll et al. | 173/12 |

FOREIGN PATENT DOCUMENTS

| | | | |
|---|---|---|---|
| 1159867 | 6/1959 | Fed. Rep. of Germany | 173/12 |

*Primary Examiner*—James L. Jones, Jr.
*Attorney, Agent, or Firm*—Michael J. Striker

[57] ABSTRACT

A torque limiting power screwdriver includes a housing in which there is supported for rotation and axial displacement a screwdriver spindle. A transmission transmits power from a motor to the screwdriver spindle. A torque overload coupling and a separating coupling are interposed in the transmission, being operative for interrupting the transmission of torque from the motor to the screwdriver spindle. The separating coupling is coupled and uncoupled in response to axial displacement of the screwdriver spindle between its coupling and uncoupling positions. The axial movement of the spindle is accomplished by a trigger movably mounted on the housing and connected by a Bowden cable or a lever transmission to the spindle. The spindle is connected by an axially movable coupling with an output member, especially with a bevel gear transmission accommodated in an angular head housing portion. A switching trigger is used to energize and de-energize the motor. The trigger and the switching trigger can be combined into a trigger unit, thus making possible one-hand operation. The trigger and switching trigger are so constructed and arranged that they force the succession of energization of the motor and coupling of the separating coupling during the commencement of operation, and the succession of uncoupling the separating coupling and de-energization of the motor during the termination of operation.

9 Claims, 4 Drawing Figures

TORQUE LIMITING POWER SCREWDRIVER

BACKGROUND OF THE INVENTION

The present invention relates to power screwdrivers in general, and more particularly to hand-held torque limiting power screwdrivers.

There are already known various constructions of power tools, such as power screwdrivers, which are so constructed as to limit the torque which can be exerted thereby on a screw or a similar threaded fastener. One such conventional power tool is disclosed in the German Pat. No. 1,678,656. This power tool includes a screwdriver spindle which is rotatably and axially displaceably mounted in a housing, a separating coupling which becomes engaged and disengaged in response to the axial movement of the screwdriver spindle so as to respectively establish and interrupt power transmission between a motor and the screwdriver spindle, and a torque overload coupling which is operative for interrupting the power transmission.

This conventional construction has the disadvantage that the range of operation thereof terminates at approximately 25 Nm of resistance torque when used in one-hand screwdriving operation. Impacting power screwdrivers are being used for the tightening of screws which require higher tightening torques; however, such impacting power screwdrivers generate a substantial amount of noise. There are also already known angular power screwdrivers which are capable of exerting higher torques. However, such angular power screwdrivers are not suited for the use of the proven combination of a separating coupling with a torque overload coupling, since it is not possible in such conventionally constructed angular power screwdrivers to simply operate the separating coupling during the application of the power screwdriver to the screw by longitudinally displacing the screwdriver spindle.

SUMMARY OF THE INVENTION

Accordingly, it is a general object of the present invention to avoid the disadvantages of the prior art.

More particularly, it is an object of the present invention to provide a power tool, especially a hand-held torque limiting power screwdriver, which does not possess the disadvantages of the conventional arrangements of this type.

Still another object of the present invention is to so construct an angular torque limiting power tool as to be able to use the combination of a separating coupling and a torque overload coupling therein.

It is yet another object of the present invention to so design the power tool of the type here under consideration as to be capable of exerting relatively high and adjustable torques at a low level of noise.

A concomitant object of the present invention is to develop a power tool of the above type which is simple in construction, inexpensive to manufacture, easy to use, and reliable in operation nevertheless.

In pursuance of these objects and others which will become apparent hereafter, one feature of the present invention resides in a torque limiting power screwdriver which comprises, in combination, a support; a screwdriver spindle mounted on the support for rotation about an axis and for limited axial displacement; means for rotating the screwdriver spindle, including a motor and a transmission interposed between the motor and the screwdriver spindle; torque overload coupling means incorporated in the transmission; an output member rotatably mounted on the support; an axially movable output coupling connecting the screwdriver spindle with the output member; separating coupling means interposed in the transmission and responsive to axial displacement of the screwdriver spindle between a coupling an an uncoupling position for respectively establishing and discontinuing torque transmission through the transmission between the motor and the screwdriver spindle; a trigger movably mounted on the support; and means for connecting the trigger with the screwdriver spindle for displacing the latter at least into its coupling position in response to movement of the trigger.

One of the main advantages of the above construction is that the output member may be constructed as a bevel gear transmission accommodated in an angular housing or housing portion, so that the proven combination of a separating coupling with an axially movable screwdriver spindle and a torsion overload coupling for the discontinuance of power or torque transmission from the motor of the power screwdriver to the screwdriver spindle can now also be employed, in accordance with the present invention, in an angular power screwdriver. In this manner, it is possible to use a power screwdriver generating only a small amount of noise even when the amount of the tightening or other torque to be applied is relatively high. The use of the longitudinally movable coupling between the screwdriver spindle and the output member, as well as of the connecting means extending between the axially movable screwdriver shaft and the separate trigger, for displacing the screwdriver spindle into its coupling position, renders it possible to use the proven combination of separating coupling operated by an axially movable shaft with torque overload coupling even in angular power screwdrivers.

The connecting means extending between the trigger and the axially displaceable screwdriver spindle may include, in accordance with one aspect of the present invention, pulling means, especially a Bowden cable, which is effective for displacing the screwdriver spindle only into is coupling position. However, it is also advantageous to construct the connecting means as a lever transmission.

The power screwdriver of the present invention is provided with a switching trigger operative for energizing and deenergizing the motor of the screwdriver. In this context, it is especially advantageous when the trigger and the switching trigger are combined with one another in a trigger unit. Then, it is further advantageous when the trigger has an operating surface, and when the switching trigger which is movable between an energizing and a de-energizing position in a trajectory of predetermined length, has an actuating surface which extends farther over the operating surface of the trigger in the de-energizing position of the switching trigger than the predetermined length of the trajectory of movement of the same. According to a further advantageous aspect of the present invention, the switching trigger includes a recess, and the trigger is accommodated in the recess of the switching trigger. A further noise reduction and improved operation are obtained when the connecting means includes a buffer, particularly a spring, situated between the trigger and the screwdriver spindle.

What is particularly advantageous about the just described construction is that it forces a desired succession of operating steps, that is, either energization of the screwdriver motor first followed by the operation of the separating coupling, on commencement of the operation of the power screwdriver, or uncoupling of the separating coupling first, followed by the de-energization of the screwdriver motor, during the termination of operation of the power screwdriver. This is rendered possible by the special construction and arrangement of the trigger for operating the axially movable screwdriver spindle and the switching trigger for the energization and de-energization of the screwdriver motor. Moreover, an additional advantage of this construction of the trigger unit is that it makes possible one-hand operation of the power tool, even when the power tool is constructed as an angular torque limiting power tool.

The novel features which are considered as characteristic of the invention are set forth in particular in the appended claims. The improved power screwdriver itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
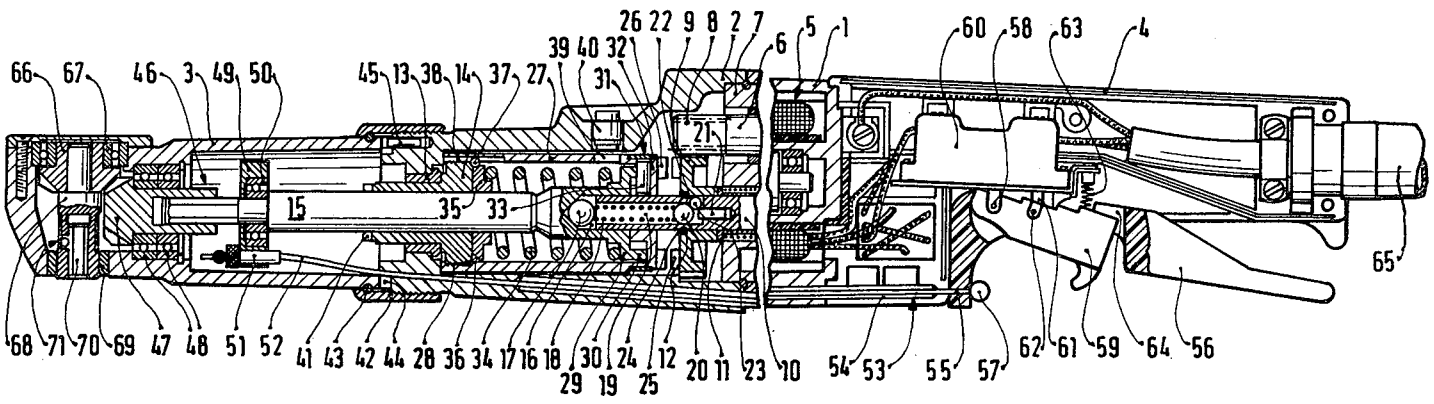
FIG. 1 is a partially sectioned side elevational view of an angular torque limiting power screwdriver according to the present invention.

Referring now to the drawing in detail, and first to FIG. 1 thereof, it may be seen that the reference numeral 1 has been used therein to identify a motor housing. The motor housing 1 is united with a transmission housing 2, an angular head housing 3 and a handgrip housing 3 to form a unitary overall housing of a limiting angular power screwdriver.

The motor housing 1 accommodates an electric motor 5. The electric motor 5 has an output shaft, which has not been shown in the drawing in any detail, and which drives in a conventional manner a countershaft 6. The countershaft 6 is supported in a bearing shield 7 provided in the transmission housing 2. One end of the countershaft 6 is shaped as a pinion 8. This pinion 8 meshes with a gear 9. The gear 9 is carried by a switching shaft 10 which is also supported in the bearing shield 7. The gear 9 is supported on the switching shaft 10 for rotation as well as for axial displacement. The switching shaft extends parallel to the countershaft 6. A helical spring 11 is slid onto the switching shaft 10 next to the gear 9 at the side closer to the handgrip housing 4 and urges the gear 9 permanently toward the angular head housing 3. This movement is limited by a locking or retaining ring 12 which is partially received in a corresponding groove provided in the switching shaft 10.

The transmission housing 2 forms a bearing 13 for a threaded sleeve 14. The threaded sleeve 14, in turn, receives a screwdriver spindle 15. The screwdriver spindle 15 is in axial alignment with the switching shaft 10. The end of the switching shaft 10 which is closer to the tool reaches into a bore 16 provided in the end of the screwdriver spindle 15 that is closer to the same. A ball or sphere 17 which is acted upon by a helical spring 18 lies at the bottom of the bore 16. The helical spring 18 is confined and guided in a bore 19 provided in the switching shaft 10. At its other end, the helical spring 18 rests against a further ball or sphere 20. An abutment pin 21 provided in the interior of the bore 19 is associated with the ball 20.

A radial bore 22 leads from the outer periphery of the switching shaft 10 to the inner end of the bore 19. The radial bore 22 receives a smaller ball or sphere 23. The sphere 23 engages the ball 20. Due to the action of the helical spring 18 on the ball 20, the latter permanently urges the smaller sphere 23 in the outward direction or holds the smaller sphere 23 in the outer position. The abutment pin 21 prevents the smaller sphere 23 from falling into the bore 19 during the assembly.

The end face of the gear 9 which faces toward the tool is provided with a turned enlargement which increases the diameter of the bearing bore of the gear 9. Coupling teeth 25 also project from this end face. The coupling teeth 25 are positioned opposite to associated coupling teeth 26 which are formed on a coupling sleeve 27. The coupling sleeve 27 overlaps a land of the threaded sleeve 14 and is threadedly connected to the threaded sleeve 14 by means of a threaded formation 28. The coupling sleeve 27 also overlaps the end of the screwdriver spindle 15 which is closer to the handgrip housing 4. The screwdriver spindle 15 has a land 29 at the region of overlap with the coupling sleever 27. The land 29 is provided at its end face with teeth 30 which constitute elements of a torque overload coupling 31.

The coupling sleeve 27 has a substantially cup-shaped bottom portion 32 which is provided with radial receiving bores for cylindrical rollers 33. The teeth 30 of the torque overload coupling 31 engage the cylindrical rollers 33 under the influence of a helical spring 34. The helical spring 34 is supported at its ther end on a support ring 35 which, in turn, abuts the threaded sleeve 14. The abutment surface of the support ring 35 is chamfered at the outer periphery of the support ring 35, to form a conical surface 36. The conical surface 36 urges a ball or sphere 37 into a longitudinal groove 38 provided in the coupling sleeve 27. The coupling sleeve 27 is provided in its circumferential wall with a hole 39 which is associated with an arresting pin or bolt 40. The arresting bolt is guided in a radial bore provided in the transmission housing 2.

The threaded sleeve 14, as well as the screwdriver spindle 15 project out of the transmission housing 2 and into the angular head housing 3. The free end of the threaded sleeve 14 is provided with teeth 41. The transmission housing 2 and the angular head housing 3 are connected with one another by means of a threaded sleeve 42 and a retaining ring 43.

A detaining arrangement is provided between the angular head housing 3 and the transmission housing 2. Such detaining arrangement includes teeth 44 provided on the end face of the angular head housing 3 which faces toward the transmission housing 2, and a pin 45 which is provided in the transmission housing 2. The presence of the detaining means renders it possible to adjust the angular position of the angular head housing 3 relative to the transmission housing 2 about the longitudinal axis of the limiting angular power screwdriver, and to detain the angular head housing 3 in any of a plurality of such relative angular positions.

The end of the screwdriver spindle 15 which is closer to the tool forms a part of a longitudinally or axially movable coupling 46. The cooperating part of the axially movable coupling 46 is arranged in a bevel gear 47 which is supported in the angular head housing 3 on antifriction or ball bearings 48. The screwdriver spindle 15 further carries, immediately behind the end of the screwdriver spindle 15 that forms the aforementioned part of the coupling 46, an entraining disc 49 which is supported on the screwdriver spindle 15 by means of an antifriction or ball bearing 50. The entraining disc 49 or its ball bearing 50 are in abutment with a step of the screwdriver spindle 15.

The entraining disc 49 has an axially parallel threaded bore which receives an entraining head 51 which is secured to an end of a wire cable core 52 of a Bowden cable 53. The cable jacket of the Bowden cable 53 is identified by the reference numeral 54. The end of the wire cable core 52 which is closest to the handgrip housing 4 passes through an opening 55 provided in a trigger 56. The end portion of the wire cable core 52 which extends beyond the opening 55 terminates in a ball 57. Thus, the ball 57 serves as an entraining element for the wire cable core 52, when the trigger 56 is moved.

The trigger 56 is pivotally mounted on a pivot axle 58 which is affixed to the handgrip housing 4. The pivot axle 58 also serves as a pivoting support for a switching trigger 59. The switching trigger 59 serves as an actuating trigger for a switch 60 which serves for energizing and de-energizing the electric motor 5. A switching link 61 which projects out of the switch 60 is connected by means of a pin 62 with the switching trigger 59. A compression spring 63 steadily biases the trigger 56 into its rest or inactive position. The switching trigger 59 is biased into its deenergizing or open position by a non-illustrated spring which is arranged in the interior of the housing of the switch 60. The switching trigger 59 is guided in a slot or recess 64 provided in the trigger 56. The excess trajectory which can be covered by the switching trigger 59 relative to the trigger 56 is greater than the switching trajectory covered for energizing the electric motor 5. The reference numeral 65 denotes a connecting electric cable.

The bevel gear 47 situated in the angular head housing 3 meshes with another bevel gear 66. The other bevel gear 66 is directly supported in an antifriction or ball bearing 67 in the angular head housing 3. A pin-shaped end portion of a key pin or bolt 68 is pressed into an axial bore of the other bevel gear 66. This key pin 68 is once more supported on the angular head housing 3 by means of a journal bearing 69. The key pin 68 is provided with a customary recess 70 of a hexagonal cross section for receiving an end portion of a tool, and with a ball snap-action holding arrangement 71 for the tool end portion.

Having so described the construction of the power screwdriver according to the present invention, its operation will now be briefly explained, still with reference to FIG. 1 of the drawing.

When a screw having, for instance, a hexagonal head, is to be threaded into a support structure, a stem of a corresponding socket is introduced into the hexagonal recess 70 of the key pin 68. After the socket has been properly positioned over the head of the screw which has been partially threaded into a corresponding threaded bore provided in the support structure, the switching trigger 59 is actuated, that is, depressed, and thus the electric motor 5 is energized. The electric motor 5 then commences to drive the gear 9. Thereafter, the trigger 56 is actuated, that is, depressed, so that the Bowden cable 53 pulls the entraining plate 49 and thus the screwdriver spindle 15 into a position in which the coupling teeth 25 and 26 engage each other. As soon as the coupling connection is established in this manner, the driving motion of the electric motor 5 is transmitted through the coupling sleeve 27 and the torque overload coupling 31 to the screwdriver spindle 15. The screwdriver spindle 15, in turn, drives, via the bevel gears 47 and 66, the key pin 68 and thus eventually the screw.

When the predetermined limiting torque is reached during the tightening of the screw, the cylindrical rollers 33 of the torque overload coupling 31 begin to roll onto the backs of the teeth 30 of the torque overload coupling 31. In this manner, the separating coupling, which consists of the coupling sleeve 27 and the gear 9, is urged in direction toward the motor housing 1. Shortly before the rollers 33 reach the summits of the teeth 30 of the torque overload coupling 31, the gear 9 reaches a position in which the ball 20 has pushed the smaller sphere 23 into the turned enlargement 24 provided at the end face of the gear 9.

As soon as the rollers 33 of the torque overload coupling 31 have passed the summits of the teeth 30, the coupling sleeve 27 moves rapidly back into its original position so that the rollers 33 fall into the gaps between the teeth 30. The small sphere 23 holds the gear 9 back. In this process, the coupling engagement of the coupling teeth 25 and 26 is discontinued and, in this manner, the transmission of the torque to the screw through the power screwdriver is interrupted.

When now the trigger 56 and the switching trigger 59 are released, the screwdriver spindle 15 first returns into its original position. Thereafter, the electric motor 5 is de-energized. During the return of the screwdriver spindle 15 into its original position, the helical spring 18 is relieved to such an extent that its force becomes insufficient to maintain the smaller sphere 23 in its outward or holding position against the action of the helical spring 11 acting on the gear 9. Thus, the gear 9 starts to move towards its position of abutment with the retaining ring 12 and presses the smaller sphere 23 into its radial bore 22 provided in the switching shaft 10. In this manner, there is restored the initial condition of the power screwdriver, and a new screw threading and tightening operation can be commenced.

When it is desired to change the limiting torque which the torque overload coupling 31 is capable of transmitting, the threaded sleeve 42 is so turned, after the loosening thereof, by means of a special key which cooperates with the teeth 41, that the tension of the helical spring 34 is varied in the desired manner. The pressure of the conical surface 36 against the ball 37 prevents an undesired change in the position of the threaded sleeve 14.

Figure 2:
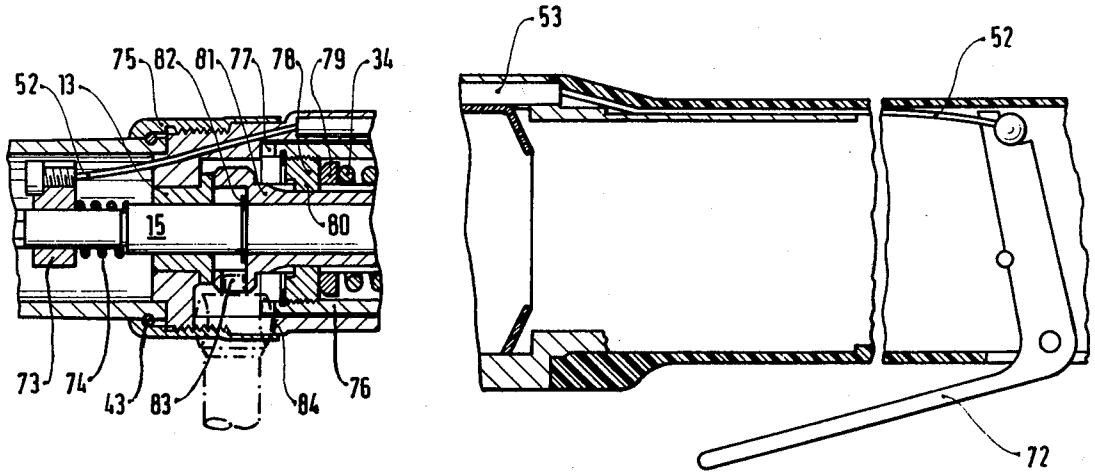
FIG. 2 is a fragmentary axial sectional view of a modified power screwdriver of the above type.

Turning now to FIG. 2, it may be seen that a differently constructed trigger 72 is being used instead of the trigger 56. A particular advantage of the construction of the trigger 72 is that it permits to apply a greater degree of displacement to the wire cable core 52 of the Bowden cable 53. To this end, the Bowden cable 53 is transferred to a different location of the overall housing 1 to 4. An entraining disc 73 which is slightly modified with respect to the entraining disc 49 is supported on the screwdriver spindle 15. The entraining disc 73 is urged by a helical spring 74 into abutment with the step of the screwdriver spindle 15. Therefore, the helical spring 74 serves as a buffer between the longitudinal movement of the wire cable core 52 of the Bowden cable 53 and the screwdriver spindle 15. A threaded sleeve 75 is used in the construction of FIG. 2 instead of the threaded sleeve 42 of the construction of FIG. 1. The threaded sleeve 75 also cooperates with the retaining ring 43.

A coupling sleeve 76 which is modified with respect to the coupling sleeve 27 is itself provided with teeth 77. A nut 78 is threaded into an internal thread of the coupling sleeve 76. The nut 78 acts on the helical spring 34 via a support ring 79. In this construction, the nut 78 is connected by a splined connection 80 with a bushing 81. The bushing 81 is supported on the screwdriver spindle 15 and abuts a securing or retaining ring 82 which is connected with the screwdriver spindle 15.

A radial bore 83 provided in a land of the bushing 81 is intended for the accomodation of a pin of a conventional drill chuck key. The drill chuck key or its pin can be introduced into the interior of the sligtly modified transmission housing 2 through an opening 84 provided in the transmission housing 2, as indicated in dash-dotted lines in FIG. 2, when the threaded sleeve 75 is unthreaded. The teeth of the drill chuck key then engage and mesh with the teeth 77 of the coupling sleeve 76. The tension of the helical spring 34 can also be changed by turning the drill chuck key, and thus a different limiting torque can be set for the torque overload coupling 31. In all other respects, the construction and mode of operation of the limiting angular screwdriver of FIG. 2 correspond to those described above in connection with the limiting angular screwdriver of FIG. 1.

Figure 3:
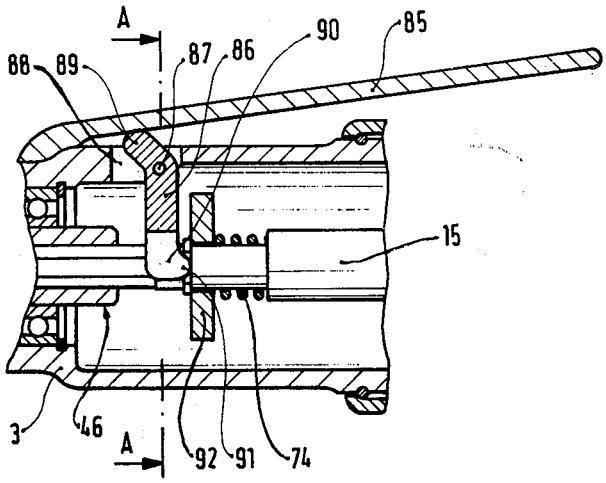
FIG. 3 is a view similar to FIG. 2 but showing a further modification.
Figure 4:
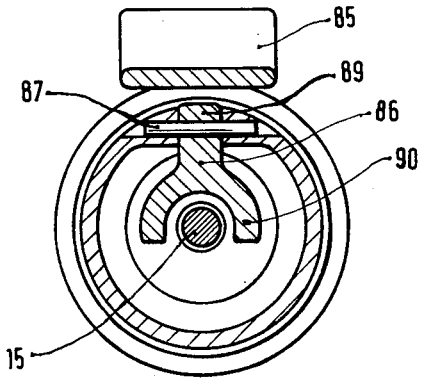
FIG. 4 is a cross-sectional view taken on line A—A of FIG. 3.

In the modified version depicted in FIGS. 3 and 4, a linkage is being used instead of the Bowden cable 53 for the engagement of the separating coupling 25, 26 via the screwdriver spindle 15. To this end, a trigger or operating member 85 is pivotally mounted on the angular head housing 3. The trigger 85 overlaps a double lever 86 which is supported on a bolt or pivot 87 in a cutout 88 of the wall of the angular head housing 3. A lever arm 89 of this double lever 86 interiorly abuts the trigger 85. The other lever arm of the double lever 86 is configurated at its end portion as a fork 90 which straddles the screwdriver spindle 15. Two protuberances 91 formed on the fork 90 engage a disc 92. A helical spring 74 is interposed between the step of the screwdriver spindle 15 and the disc 74 to act as a buffer.

Similarly to the construction according to FIG. 2, even in the construction of FIGS. 3 and 4 the energization and deenergization of the electric motor 5 must be accomplished by a separate switch. In all other respects, the construction and mode of operation of this modified construction correspond to those discussed above in connection with FIG. 1.

It will be understood that each of elements described above, or two or more together, may also find a useful application in other types of arrangements differring from the type described above, especially in other types of power tools.

While the invention has been illustrated and described as embodied in a limiting angular power screwdriver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A limiting power screwdriver, comprising a support; a screwdriver spindle mounted on said support for rotation about an axis and for limited axial displacement; means for rotating said screwdriver spindle, including a motor and a transmission interposed between said motor and said screwdriver spindle; torque overload coupling means incorporated in said transmission; and output member rotatably mounted on said support; an axially movable output coupling connecting said screwdriver spindle with said output member; separating coupling means interposed in said transmission and responsive to axial displacement of said screwdriver spindle between a coupling and an uncoupling position for respectively establishing and discontinuing torque transmission through said transmission between said motor and said screwdriver spindle; a trigger movably mounted on said support; and means for connecting said trigger with said screwdriver spindle at least for displacing said screwdriver spindle into said coupling position in response to movement of said trigger.

2. The power screwdriver as defined in claim 1, wherein said connecting means includes pulling means effective for displacing said screwdriver spindle only into said coupling position.

3. The power screwdriver as defined in claim 2, wherein said pulling means is a Bowden cable.

4. The power screwdriver as defined in claim 1, wherein said connecting means includes a lever transmission.

5. The power screwdriver as defined in claim 1, further comprising a switching trigger for energizing and de-energizing said motor.

6. The power screwdriver as defined in claim 5, wherein said trigger and said switching trigger are combined with one another in a trigger unit.

7. The power screwdriver as defined in claim 6, wherein said trigger has an operating surface; and wherein said switching trigger is movable between an energizing and a de-energizing position in a trajectory of a predetermined length and has an actuating surface which extends farther over the operating surface of said trigger in said de-energizing position than said predetermined length.

8. The power screwdriver as defined in claim 6, wherein said switching trigger includes a recess; and wherein said trigger is accoomodated in said recess.

9. The power screwdriver as defined in claim 1, wherein said connecting means further includes a buffer situated between said trigger and said screwdriver spindle.

* * * * *